US008336626B2

(12) United States Patent
Hern et al.

(10) Patent No.: US 8,336,626 B2
(45) Date of Patent: Dec. 25, 2012

(54) DOWNHOLE MAGNETIC RETRIEVAL DEVICES WITH FIXED MAGNETIC ARRAYS

(75) Inventors: Gregory L. Hern, Porter, TX (US); Larry T. Palmer, Spring, TX (US); Paul L. Connell, Spring, TX (US); Jonathan F. Nelson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 333 days.

(21) Appl. No.: 12/782,304

(22) Filed: May 18, 2010

(65) Prior Publication Data

US 2011/0284203 A1 Nov. 24, 2011

(51) Int. Cl.
*E21B 31/06* (2006.01)
*E21B 37/00* (2006.01)

(52) U.S. Cl. ..... 166/311; 166/66.5; 175/328

(58) Field of Classification Search ..... 166/311, 166/66.5, 99; 175/320, 328
See application file for complete search history.

(56) References Cited

U.S. PATENT DOCUMENTS

| | | | | |
|---|---|---|---|---|
| 3,089,724 | A * | 5/1963 | Crooks | 294/65.5 |
| 3,637,033 | A * | 1/1972 | Mayall | 175/320 |
| 4,113,611 | A * | 9/1978 | Gohm | 209/215 |
| 4,367,143 | A * | 1/1983 | Carpenter | 210/222 |
| 5,024,271 | A * | 6/1991 | Meihua | 166/66.5 |
| 5,700,376 | A * | 12/1997 | Carpenter | 210/695 |
| 6,068,768 | A * | 5/2000 | Carpenter | 210/222 |
| 6,230,796 | B1 * | 5/2001 | Tovar De Pablos | 166/66.5 |
| 6,357,539 | B1 * | 3/2002 | Ruttley | 175/328 |
| 6,439,303 | B1 | 8/2002 | Sorhus et al. | 166/99 |
| 6,491,117 | B2 * | 12/2002 | Ruttley | 175/328 |
| 6,655,462 | B1 | 12/2003 | Carmichael et al. | 100/311 |
| 7,137,449 | B2 | 11/2006 | Silguero | 166/301 |
| 7,219,724 | B2 | 5/2007 | Theriot, Sr. | 166/66.5 |
| 7,353,873 | B2 * | 4/2008 | Borst et al. | 166/304 |
| 7,513,299 | B2 | 4/2009 | Ruttley | |
| 7,753,114 | B1 * | 7/2010 | Penisson | 166/99 |
| 2010/0181064 | A1 * | 7/2010 | Knobloch et al. | 166/99 |

* cited by examiner

*Primary Examiner* — Daniel P Stephenson
(74) *Attorney, Agent, or Firm* — Shawn Hunter

(57) ABSTRACT

A magnetic retrieval tool used for collecting metallic debris and material from within a wellbore or other surrounding downhole tubular. The tool includes a tool mandrel with one or more pockets formed in its outer radial surface. A removable insert resides within each pocket. Each of the inserts retains a plurality of individual magnets in a fixed array or matrix surrounding the mandrel.

25 Claims, 13 Drawing Sheets

Fig. 19
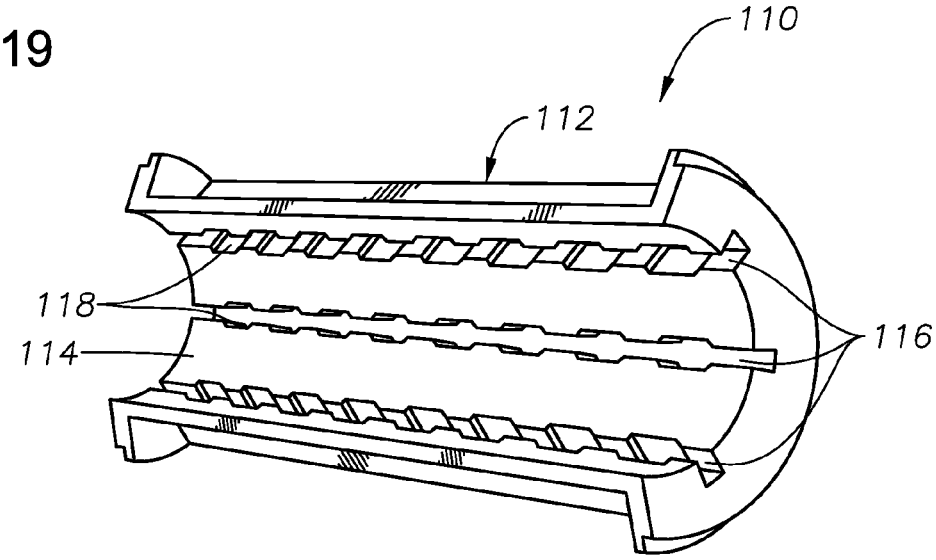
Fig. 20
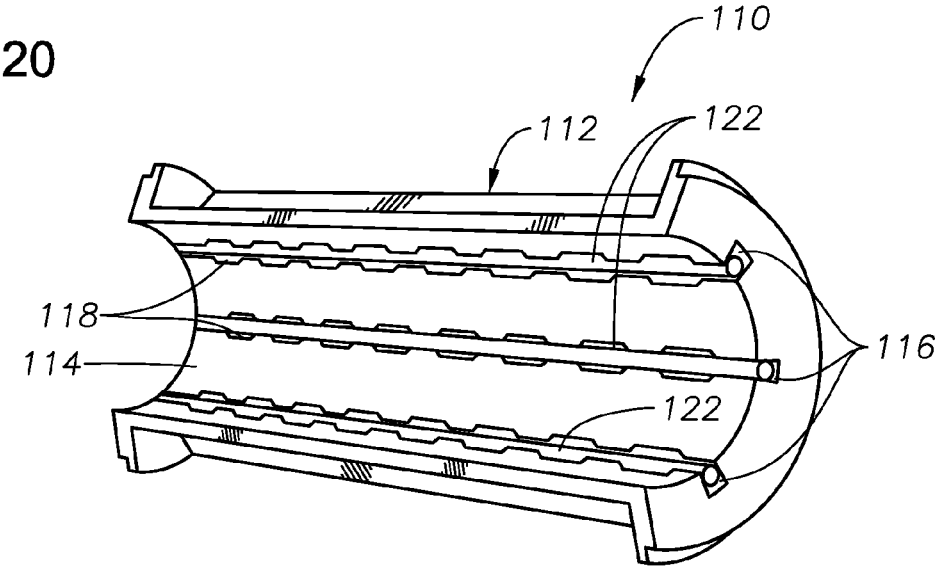
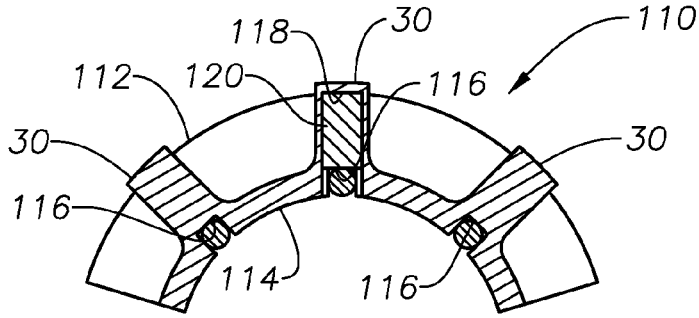
Fig. 21

DOWNHOLE MAGNETIC RETRIEVAL DEVICES WITH FIXED MAGNETIC ARRAYS

BACKGROUND OF THE INVENTION

1. Field of the Invention

The invention relates generally to systems and methods for cleaning the interior of tubular members. In particular aspects, the invention relates to methods and devices for removing metallic debris from tubular members using magnets. In still other particular aspects, the invention relates to devices and methods for retaining a plurality of magnets within a fixed array or matrix within one or more housings that surround a mandrel.

2. Description of the Related Art

Metallic debris accumulates within wellbores and other tubular members during production of subterranean fluids, such as hydrocarbon fluids. This metallic debris typically includes tiny metal shavings and cuttings. These shavings and cuttings result from numerous frictional operations that might occur within the wellbore or tubular, including the cutting of sidetracking windows, milling, drilling through of stuck devices and objects, as well as general operations that cause metal-to-metal scraping to occur.

Devices used for the removal of metallic debris by magnets are described, for example, in U.S. Pat. No. 7,513,299, U.S. Pat. No. 7,219,724 and U.S. Pat. No. 7,137,449.

SUMMARY OF THE INVENTION

The invention provides magnetic retrieval tools for use in a wellbore or other tubular member to remove metallic debris. In preferred embodiments, a retrieval apparatus includes a tool mandrel with magnet pockets. In addition, the tool mandrel preferably includes a central collar with keyed openings. The retrieval apparatus preferably includes a plurality of removable, modular magnetic bars which reside within the magnet pockets of the tool mandrel. Spacers also preferably surround the tool mandrel and help to retain the magnetic bars. The tool also preferably carries stabilizers to help centralize the magnetic bars within a surrounding tubular.

In various embodiments, the invention provides devices and methods for retaining a plurality of individual magnets in a fixed array or matrix and for releasably retaining this array or matrix of magnets around the tool mandrel. These devices and methods ensure that the magnets are not retained so close to the mandrel that they are difficult to remove from the mandrel due to magnetic attraction forces. In certain embodiments, bars or housings retain the magnets a predetermined distance from the mandrel. In other embodiments, a non-magnetic spacer member is used to space the magnets a fixed distance away from the mandrel.

In one embodiment, magnetic bars are provided that have a body with an interior radial surface and an outer radial surface. The outer radial surface faces a wellbore or surrounding tubular when the bar is installed within a magnet pocket. The inner radial surface faces the tool mandrel when the bar is so installed. The interior radial surface of each bar includes one or more magnet-retaining recesses within which complimentary-shaped magnets are placed. A removable cover is preferably disposed onto the interior radial surface of each bar to retain the magnets in place within their recesses.

In one embodiment of the present invention, the magnetic bars of the magnetic retrieval tool each provide one or more fins which project radially outwardly from a base portion. The fins are separated from one another by recesses within which metallic debris is captured upon being attracted by the magnets within the fins of the magnetic bars. In this embodiment, both magnetic poles of the magnetic element are available to attract metallic debris.

An alternative embodiment of the invention features a tool mandrel with recesses that retain magnetic bars as well. In this embodiment, the magnetic bars present substantially smooth outer radial surfaces and encase a plurality of small cylindrical magnets.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein:

FIG. 19 is an external, isometric view of a radially-interior surface of an alternative exemplary housing in accordance with the present invention.

FIG. 20 is an external, isometric view of the housing shown in FIG. 19, now with magnets and retaining strips inserted.

FIG. 21 is an axial cross-section of the housing shown in FIG. 20.

DETAILED DESCRIPTION OF THE PREFERRED EMBODIMENTS

FIGS. 1-8 and 9 illustrate a first exemplary magnetic retrieval tool 10 that is constructed in accordance with the present invention. The tool 10 includes a cylindrical tool mandrel 12 which defines a central flowbore 14 (see FIG. 2) along its length. The tool mandrel 12 is provided with threaded connections 16 at its axial ends to permit the tool 10 to be incorporated into a downhole work string.

Figure 1:
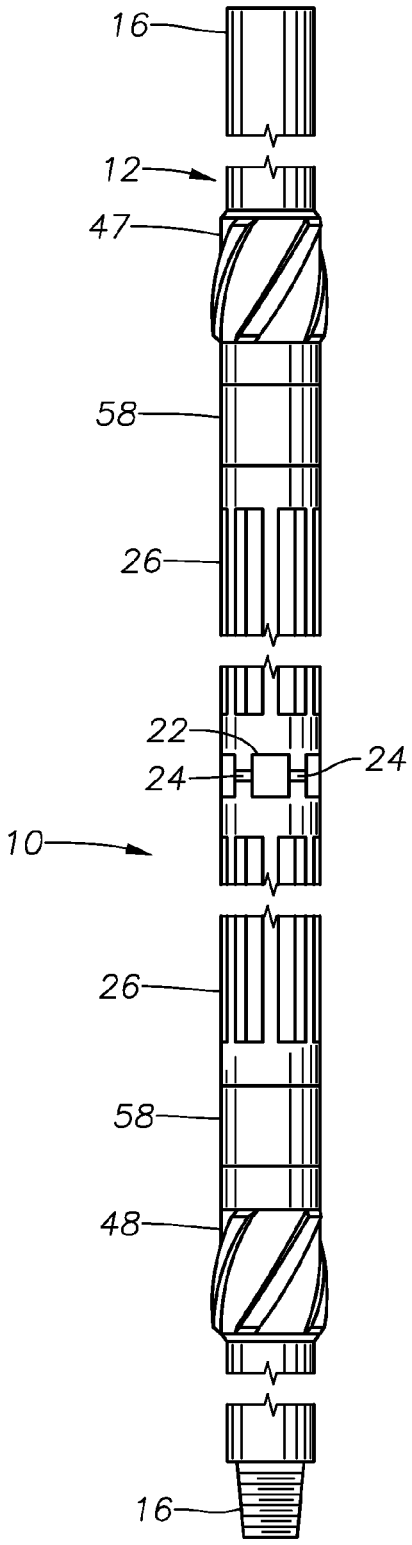
FIG. 1 is a side, external view of an exemplary magnetic retrieval tool constructed in accordance with the present invention.
Figure 2:
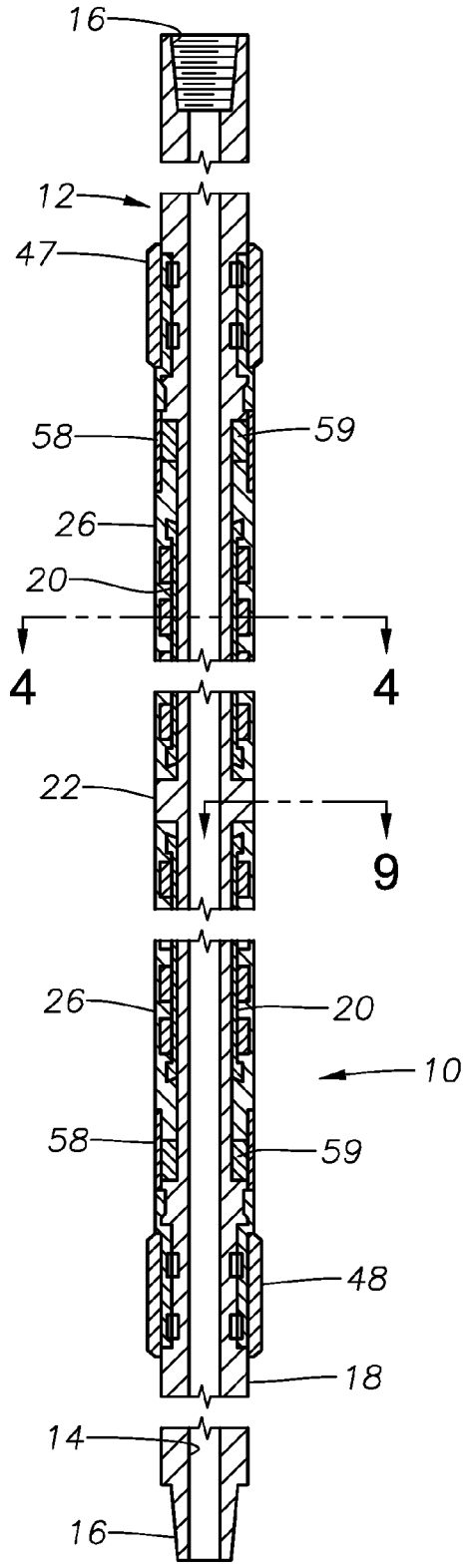
FIG. 2 is a side, cross-sectional view of the tool depicted in FIG. 1.
Figure 3:
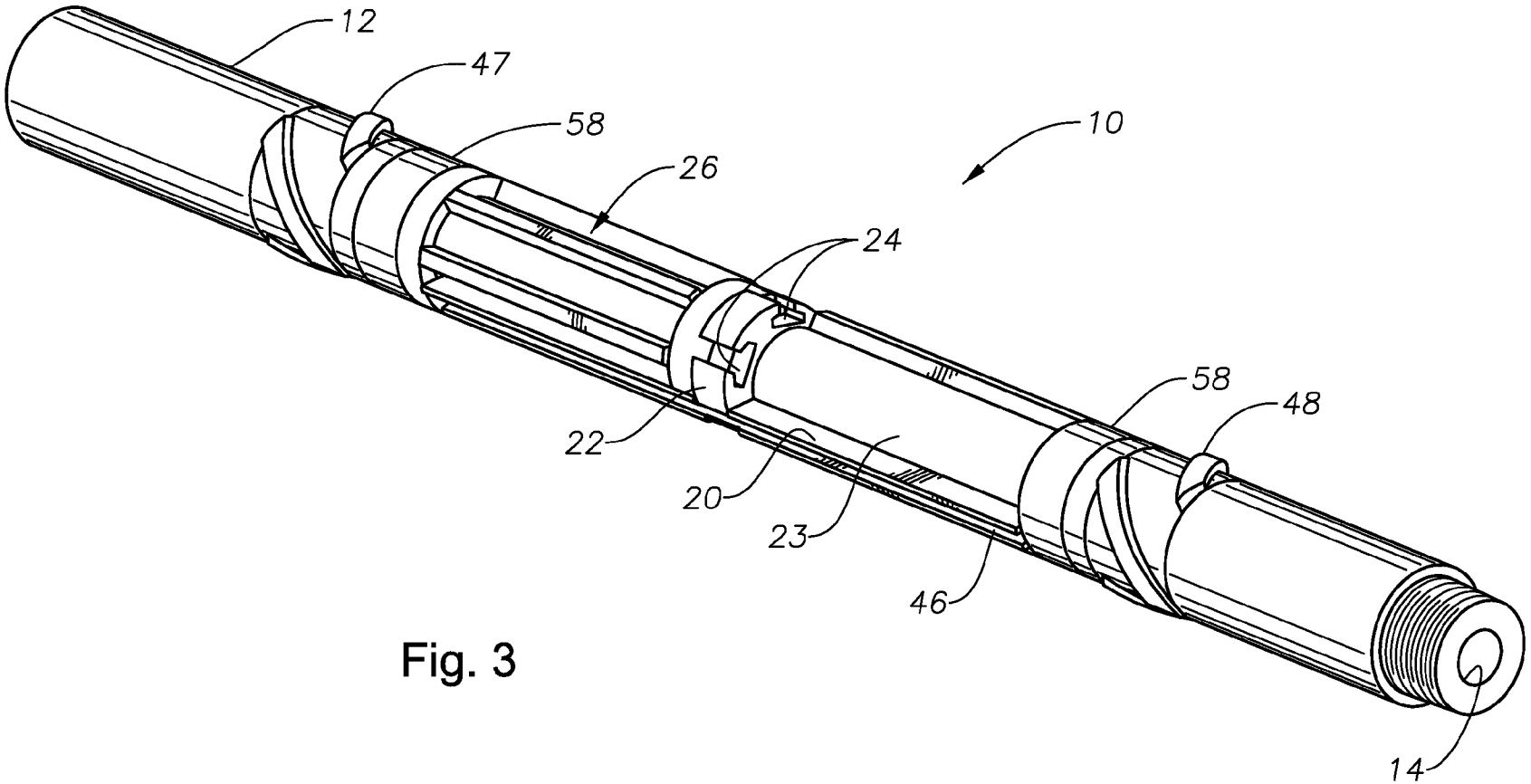
FIG. 3 is an external isometric view of the tool depicted in FIGS. 1-2.

The tool mandrel 12 presents an outer radial surface 18 with a plurality of recessed pockets 20 formed therewithin. In the depicted embodiment, there are four pockets 20. Each of the pockets 20 is preferably axially elongated and arcuately curved, as shown in FIG. 3, wherein an empty pocket 20 is shown. In the depicted embodiment, each pocket 20 is located on the opposite side of the mandrel 12 from another pocket 20. In this embodiment, the pockets 20 provide an essentially semi-circular opening. The tool mandrel 12 also presents a radially-enlarged collar 22 which projects radially outwardly from a reduced diameter portion 23 of the tool mandrel 12 and includes keyed openings 24 (see FIG. 3).

Figure 5:
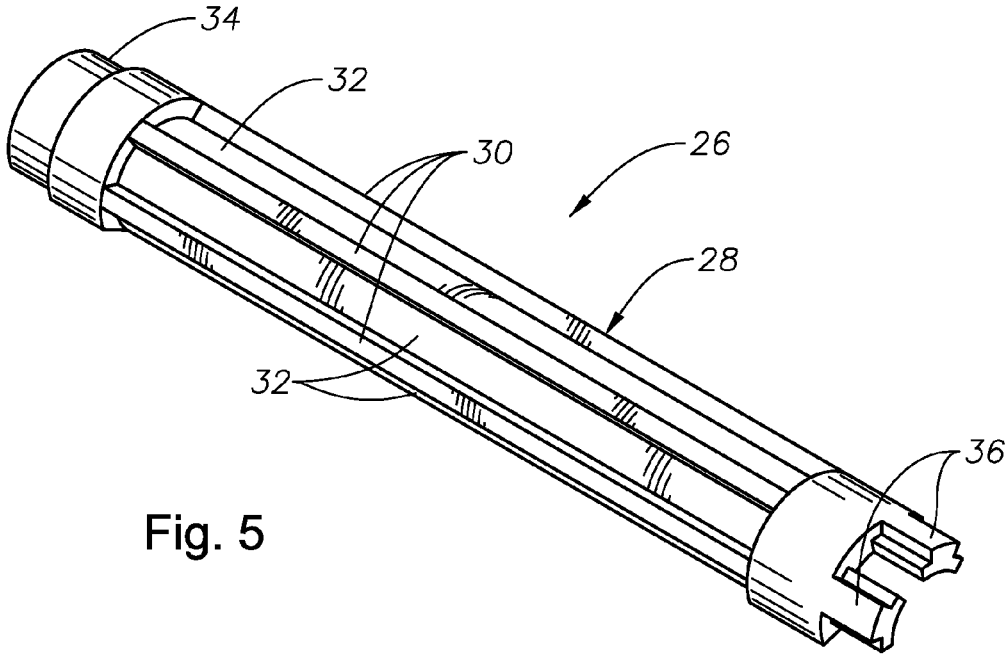
FIG. 5 is an isometric view of an exemplary magnetic bar used in the tool shown in FIGS. 1-4, illustrating features of the exterior radial surface of the bar.
Figure 6:
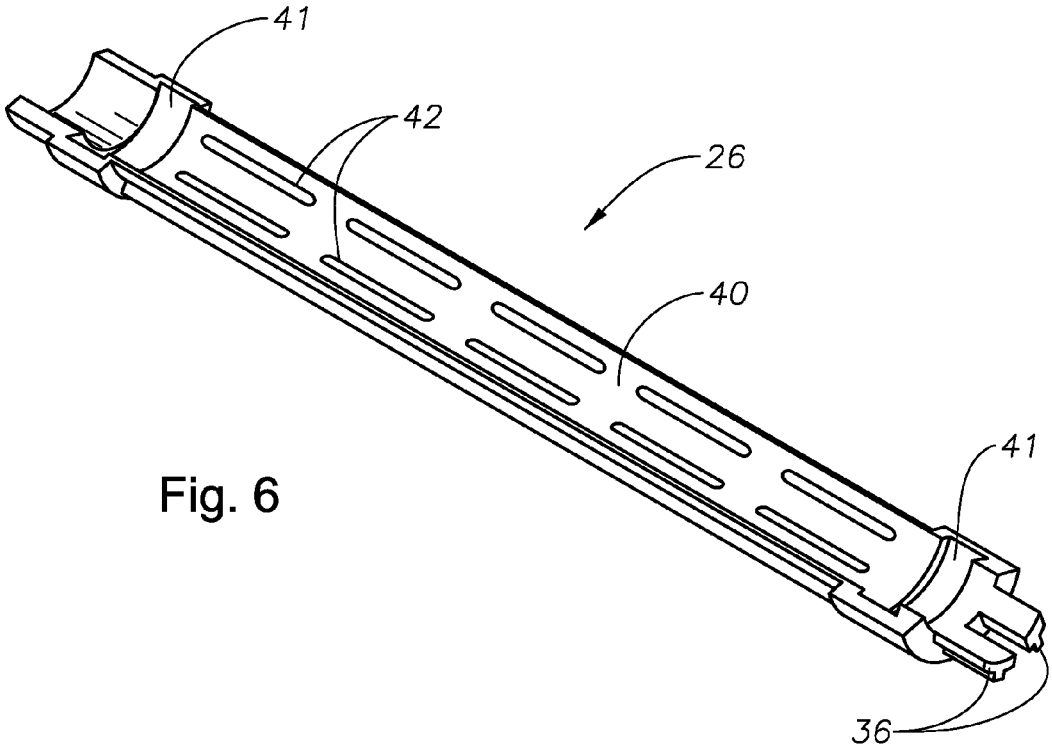
FIG. 6 is an isometric view of the magnetic bar shown in FIG. 5, depicting features of the interior radial surface of the bar.
Figure 7:
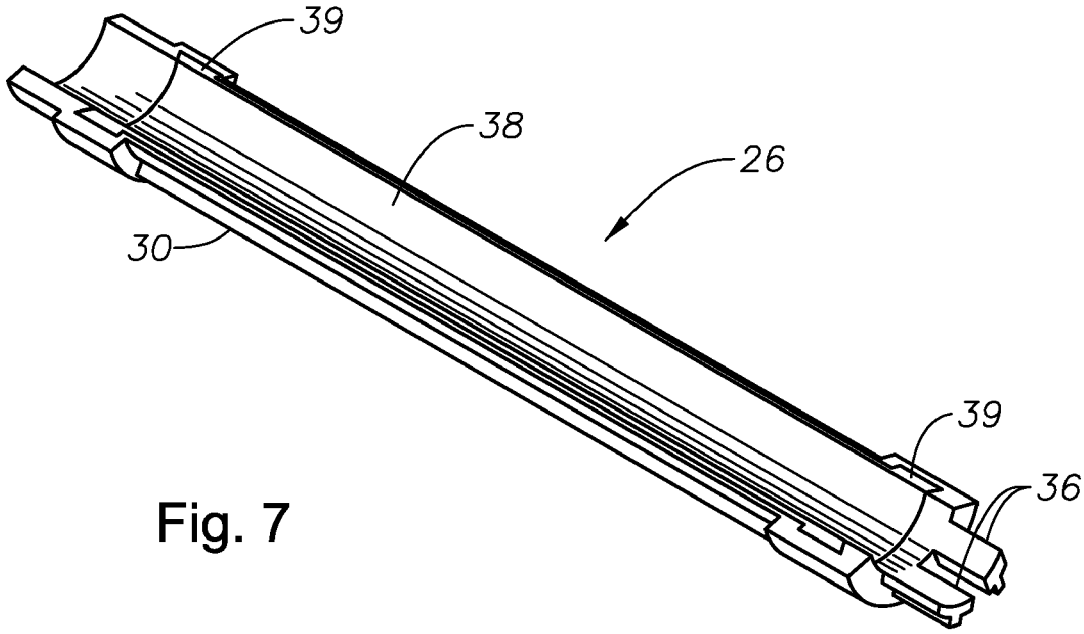
FIG. 7 is a further isometric view of the interior radial surface of the magnetic bar shown in FIGS. 5-6, now with an interior cover in place.
Figure 9:
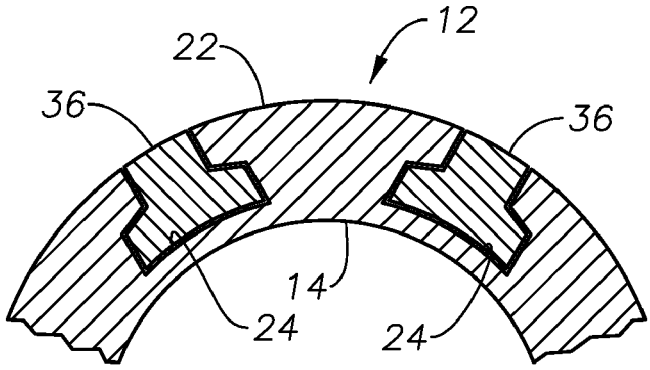
FIG. 9 is an axial cross-section taken along lines 9-9 in FIG. 2.

The exemplary magnetic retrieval tool 10 also includes a plurality of removable inserts 26 that reside within the pockets 20 in a complimentary manner. An exemplary insert 26 is depicted in FIGS. 5-7 apart from the other components of the tool 10. The insert 26 presents an outer radial surface 28 having a plurality of axially-oriented, outwardly-projecting fins 30 which are separated by recesses 32. One axial end of the insert 26 includes an arcuately curved engagement portion 34 (see FIG. 5). The other axial end of the insert 26 presents a plurality of keys 36 which extend axially outwardly from the bar 26. The keys 36 are shaped and sized to reside within the keyed openings 24 of the collar 22 (see FIG. 9). Those of skill in the art will understand that the keys 36 and openings 24 may be made in many different shapes so long as they are complimentary to one another.

Figure 4:
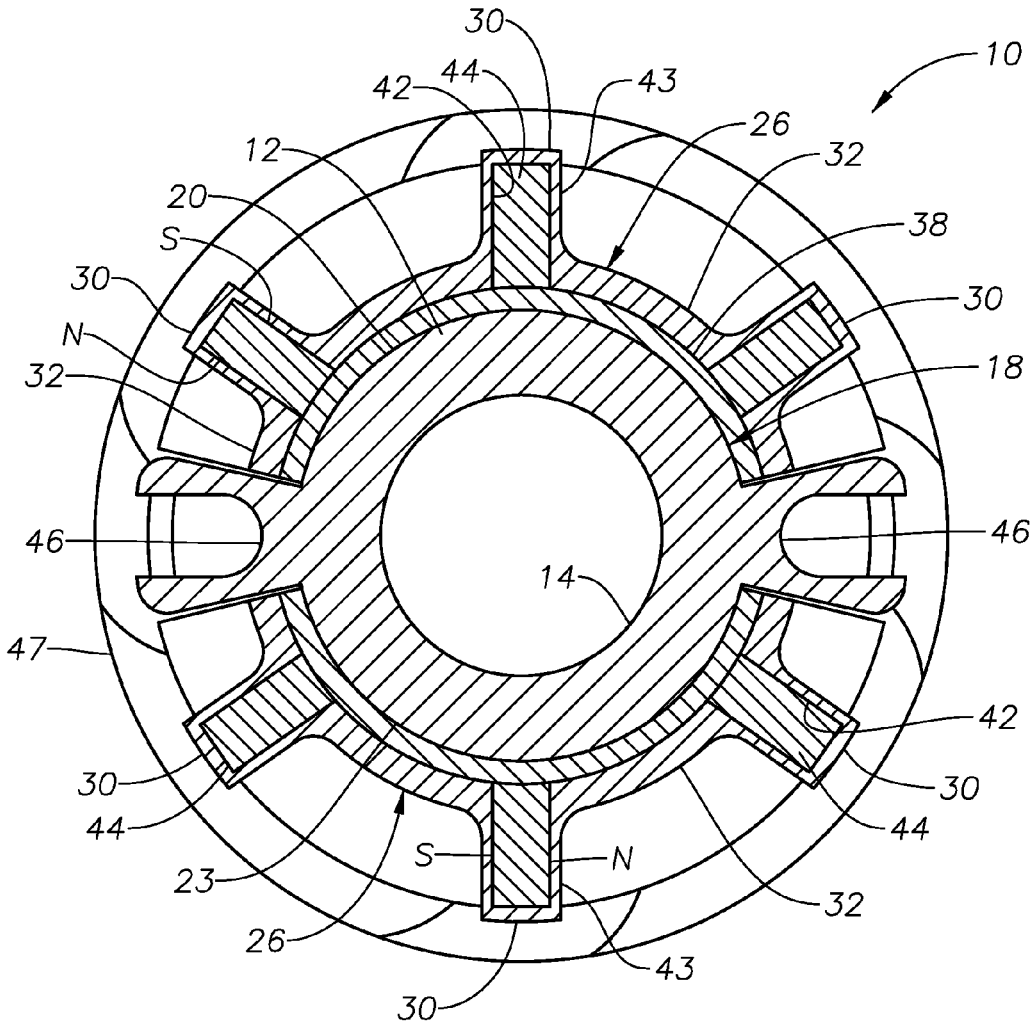
FIG. 4 is an axial cross-sectional view taken along lines 4-4 in FIG. 2.

FIGS. 6 and 7 depict the interior radial portions of the insert 26. The interior radial portion of the insert 26 is provided with a removable cover 38. The cover 38 is shown in place in FIG. 7 while FIG. 6 shows the insert 26 with the cover 38 removed. FIG. 6 illustrates that the interior radial surface 40 of the insert 26 has a plurality of magnet-retaining recesses 42 into which removable magnets 44 (see, e.g., FIG. 8) reside. As can be seen in FIG. 4, the recesses 42 and magnets 44 are each located within one of the fins 30. The exemplary magnets 44 have an elongated body having a generally rectangular cross-section. However, the magnets 44 may have other suitable cross-sectional shapes or configurations, including round, oval, triangular, or irregular. It can be appreciated that each insert 26 retains its respective multiple magnets 44 in a fixed array or matrix surrounding the mandrel 12. Further, the array of magnets 44 can be readily affixed to or removed from a surrounding relation to the mandrel 12.

Once the magnets 44 are placed within the recesses 42, the cover 38 is slid into place by disposing tapered tabs 39 on the cover 38 into grooves 41 on the insert 26. The cover 38 will retain the magnets 44 within the recesses 42 of the insert 26. In addition, the cover 38 preferably isolates the magnets 44 magnetically from the mandrel 12. It is noted that the magnetic bars 26 themselves and covers 38 are preferably made of non-magnetic material. However, the magnets 44 that are retained within the inserts 26 provide the magnetic force used to remove metallic debris from a wellbore or other tubular member. Because a non-magnetic cover 38 is disposed in between the mandrel 12 and each magnet 44, the magnets 44 are substantially isolated magnetically from the mandrel 12, thereby making the inserts 26 substantially easier to remove from the mandrel 12.

As FIG. 4 shows, the magnets 44 are located within the fins 30 of the inserts 26 when installed. The fins 20 provide a structural protective housing for the individual magnets 44. Location of the magnets 44 within the fins 30 of the inserts 26 also provides for an enlarged magnetized surface area on the outer radial surface 28 of the inserts 26. FIG. 4 illustrates that the magnets 44 present lateral north (N) and south (S) poles which provide magnetic attraction on both lateral sides 43 of the fins 30. Metallic debris that is attracted by the magnets 44 will be captured within the recesses 32 between the fins 30. The recesses 32 provide protected chambers to prevent magnetically-attracted debris from being dislodged when the tool 10 is being removed from a surrounding wellbore or other tubular.

Preferably, the tool mandrel 12 also defines a pair exterior fluid flowpaths 46 (see FIGS. 3 and 4). If, during operation, the recesses 32 become filled with debris, fluid within a surrounding wellbore can still flow past the tool 10 via the flowpaths 46.

It is further preferred that the magnetic retrieval tool 10 includes stabilizers 47, 48 that radially surround the tool mandrel 12 and are used to centralize the magnetic bars 26 of the tool 10 within a surrounding tubular during operation. Each of the stabilizers 47, 48 are rotatable with respect to the tool mandrel 12. In a currently preferred embodiment, the stabilizers 47, 48 are formed of mating semi-cylindrical halves that are assembled around the outer circumference of the tool mandrel 12.

Figure 8:
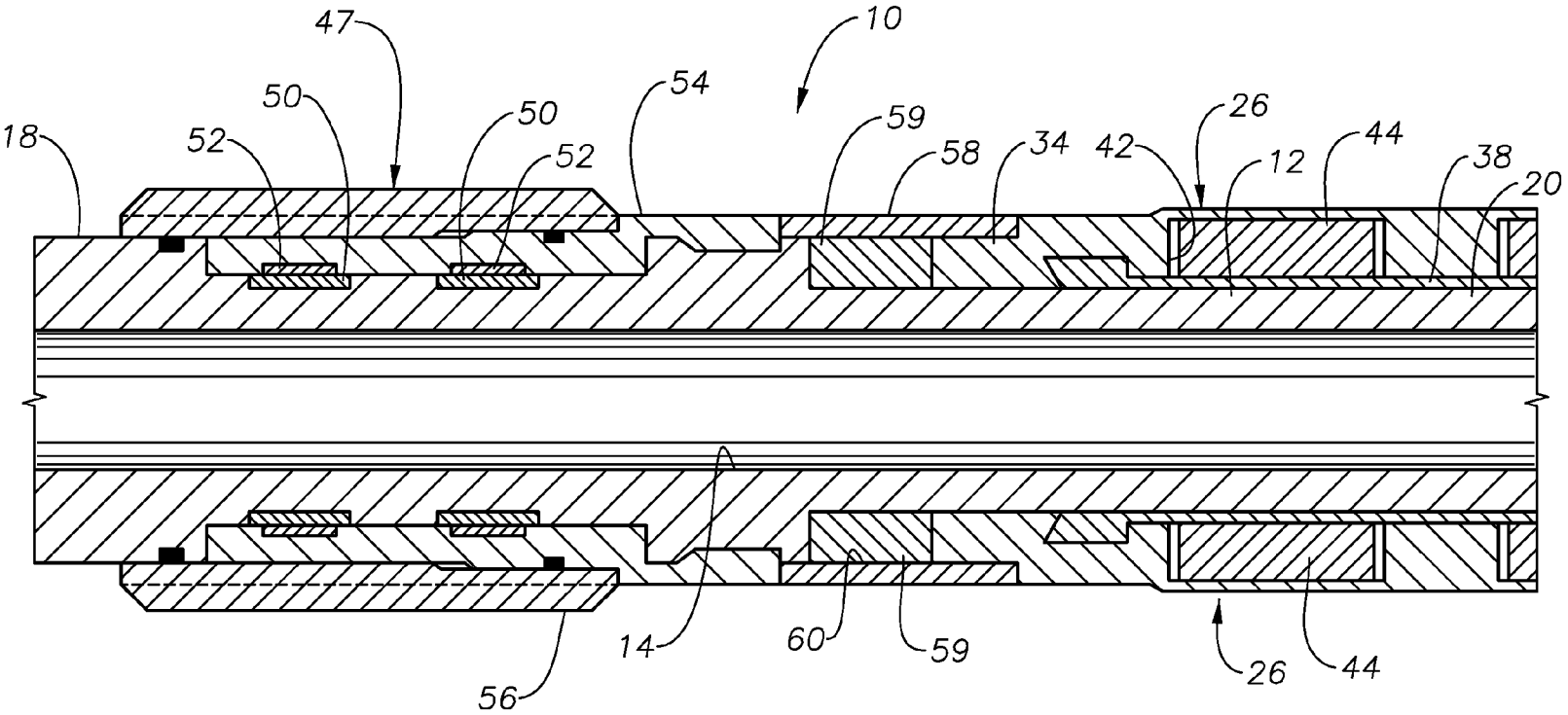
FIG. 8 is an enlarged side, cross-sectional view of portions of the tool shown in FIGS. 1-3.

FIG. 8 depicts in detail one exemplary method of securing the stabilizer 47 around the tool mandrel 12. Construction of the stabilizer 48 mirrors this. Bearing races 50 radially surround the tool mandrel 12. Roller bearings 52 are disposed between the split bearing races 50 and a surrounding split roller sleeve 54 so that the split roller sleeve 54 can rotate easily with respect to the tool mandrel 12. Roller bearings 52 can be split needle roller bearings, bushings or full compliment roller bearings. A stabilizer sleeve 56 radially surrounds the split roller sleeve 54 and will rotate about the tool mandrel 12 with the split roller sleeve 54.

Figure 8A:
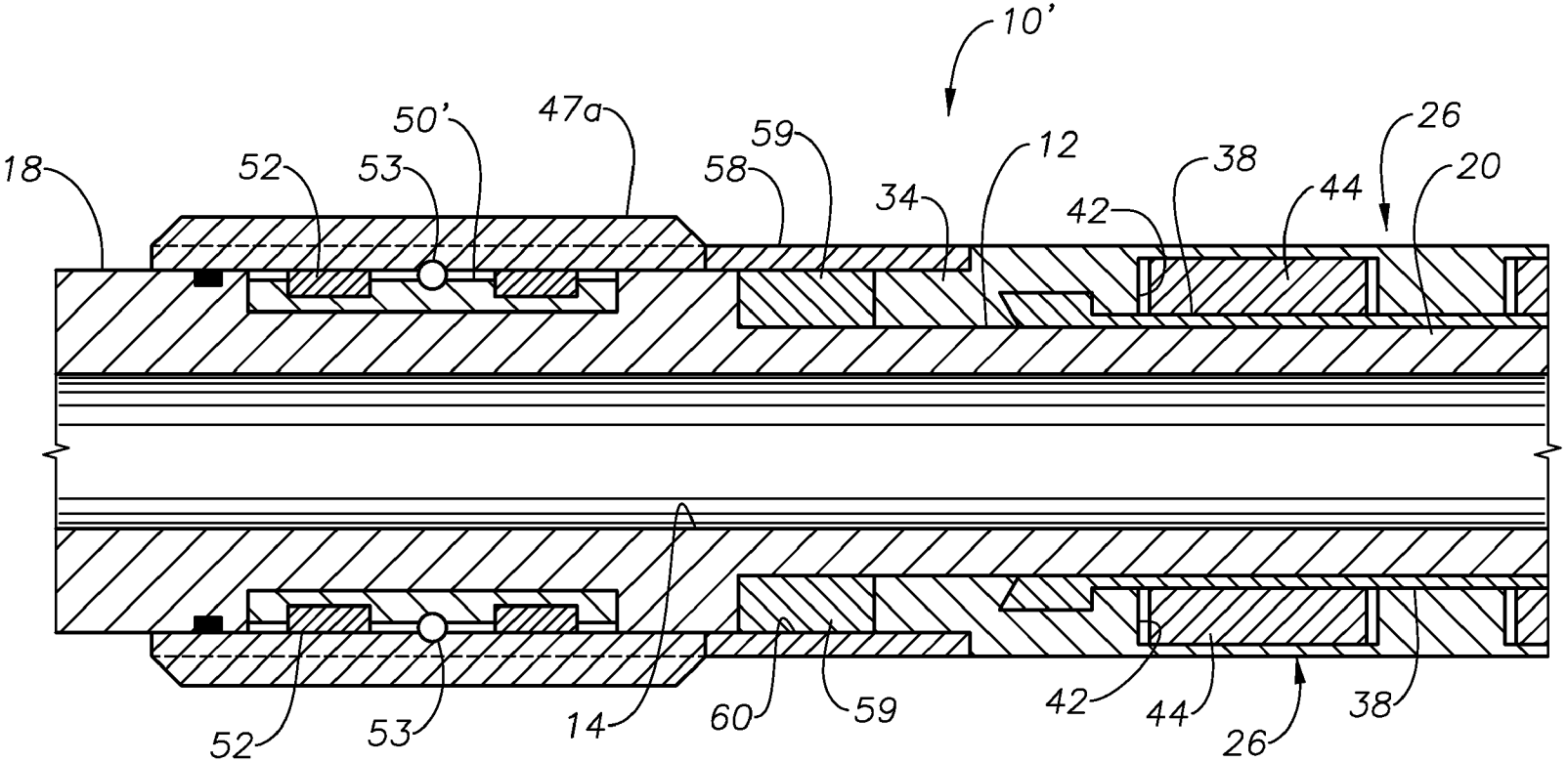
FIG. 8A is an enlarged side, cross-sectional view of an alternative embodiment of a tool constructed in accordance with the present invention.

FIG. 8*a* depicts an alternative tool 10' which has been constructed in accordance with the present invention. The tool 10' is constructed in the same manner as the tool 10, previously described, except where indicated. In the tool 10', there is a single split bearing race 50' disposed around the tool mandrel 12 for the stabilizer sleeve 47*a*. Roller bearings 52 and ball bearings 53 are disposed between the split bearing race 50' and the surrounding stabilizer sleeve 47*a*.

It is noted that in both the tool 10 in FIG. 8 and the tool 10', shown in FIG. 8A, spacers 59 lie adjacent inserts 26 to maintain engagement between keys 36 and keyed openings 24 of collar 22. In tool 10 in FIG. 8, retaining ring 58 slides over spacers 59 and lies adjacent the roller sleeve 54. In FIG. 8A retaining ring 58 slides over spacers 59 and lies adjacent the stabilizer 47*a*. The interior radial surface 60 of the retaining ring 58 contacts the engagement portion 34 of the adjacent inserts 26, thereby retaining the inserts 26 within their respective pockets 20. In order to assemble the tool 10, the keys 36 of the inserts 26 are disposed within the keyed openings 24 of the collar 22. The inserts 26 are disposed within their respective pockets 20 as this is done. Thereafter, spacers 59 are installed in pockets 20, and retaining ring 58 is slid onto each axial end of the tool mandrel 12 and in surrounding contact with the engagement portions 34 of the bars 26. Then, the stabilizers 47, 48 are installed onto the tool mandrel 12.

Figure 10:
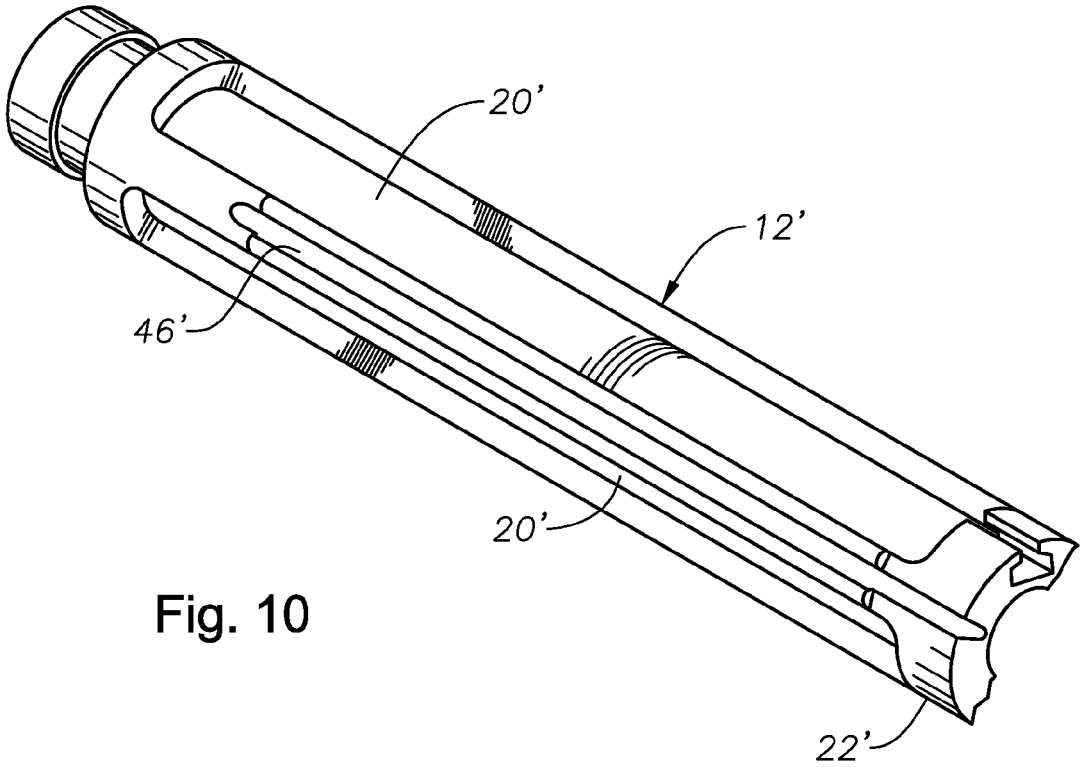
FIG. 10 is an isometric view of an exemplary tool mandrel for an alternative magnetic retrieval tool constructed in accordance with the present invention.
Figure 11:
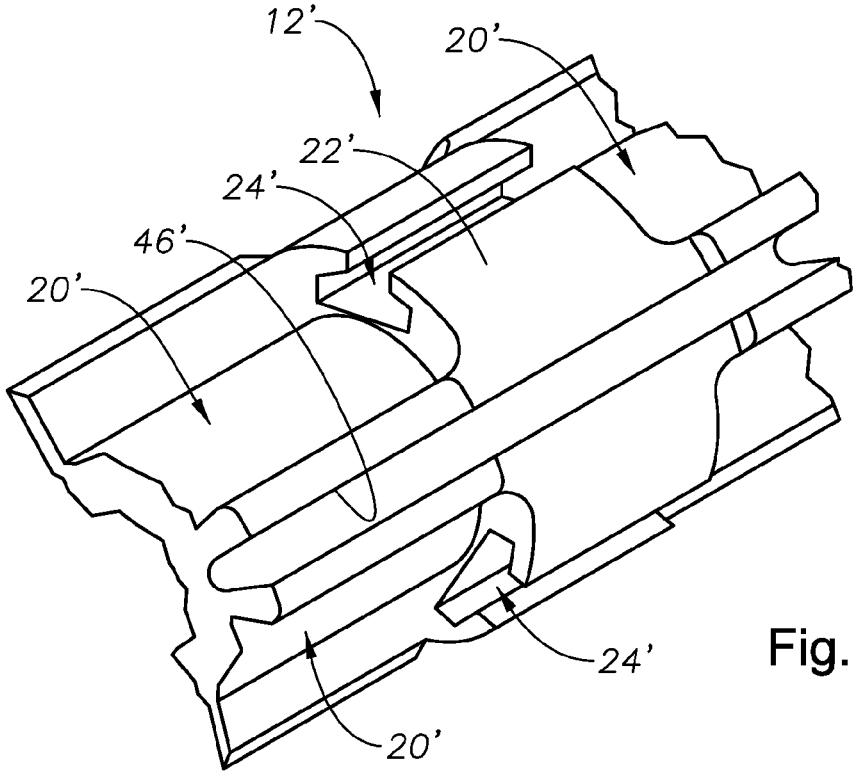
FIG. 11 is an enlarged isometric view of portions of the tool mandrel shown in FIG. 10.
Figure 13:
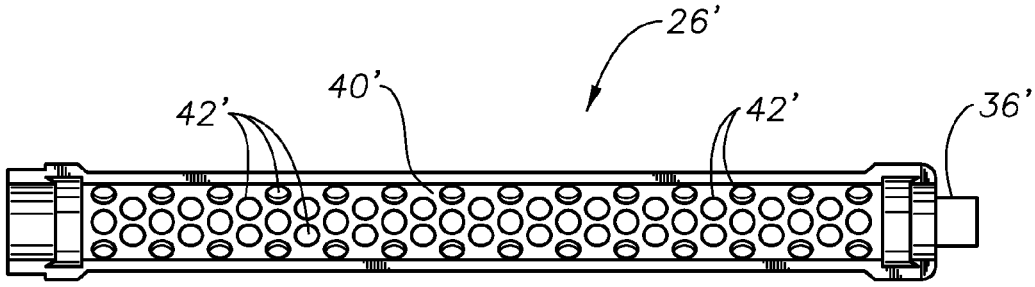
FIG. 13 is a bottom view of the magnetic bar shown in FIG. 12.
Figure 14:
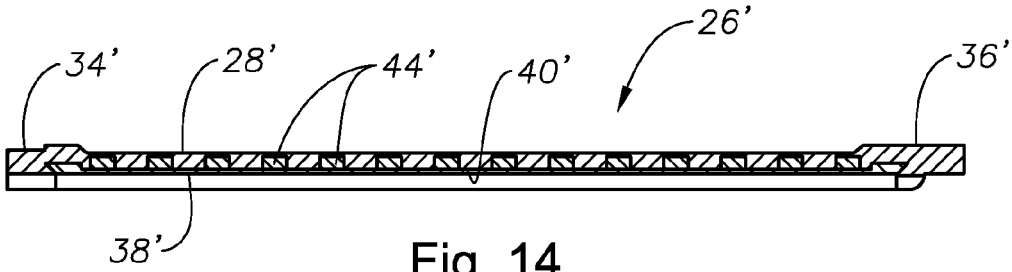
FIG. 14 is an axial cross-sectional view of the bar shown in FIGS. 12 and 13, now with an interior cover in place.
Figure 15:
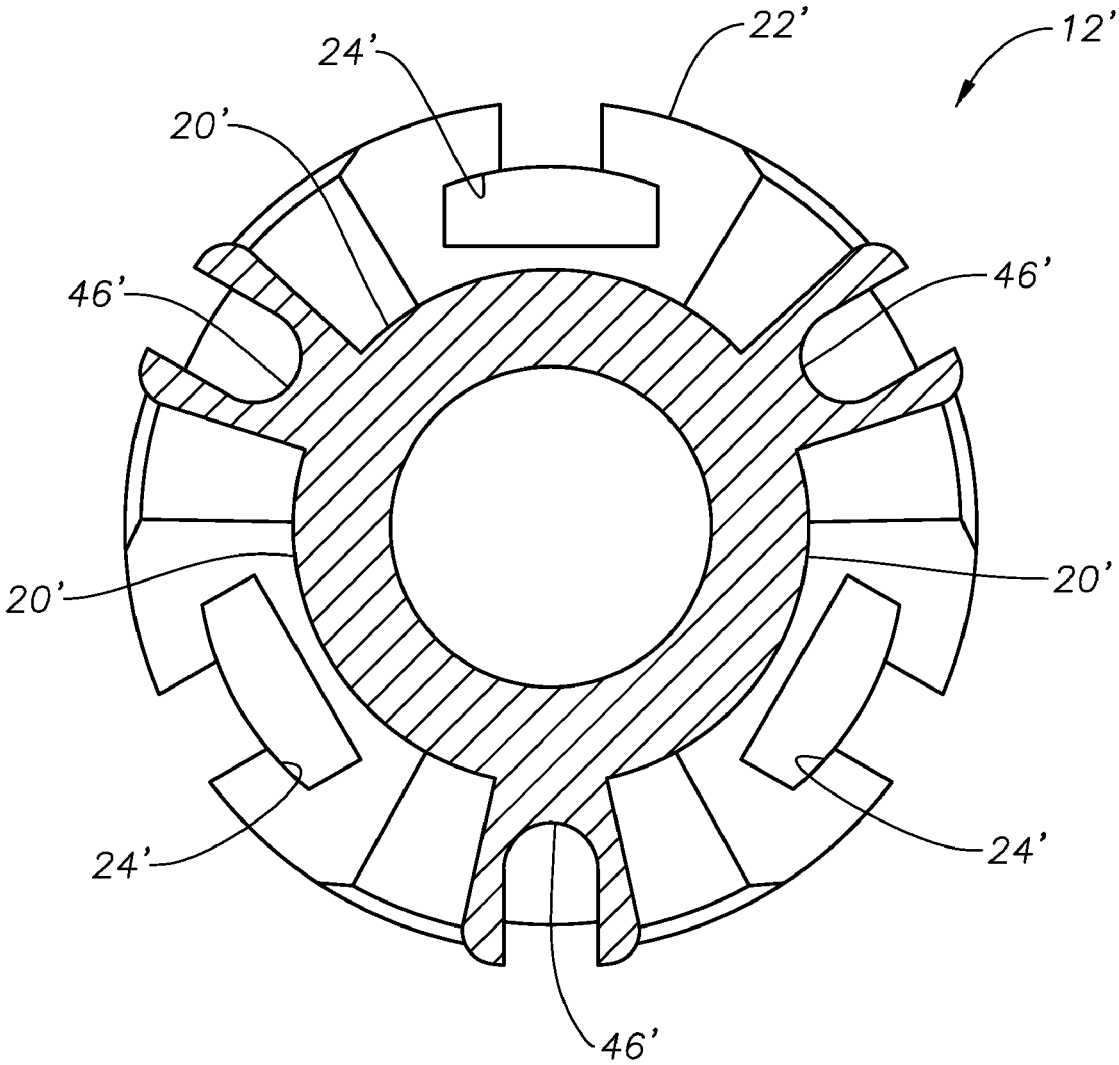
FIG. 15 is an axial cross-section of the tool mandrel taken along lines 15-15 in FIG. 10.
Figure 16:
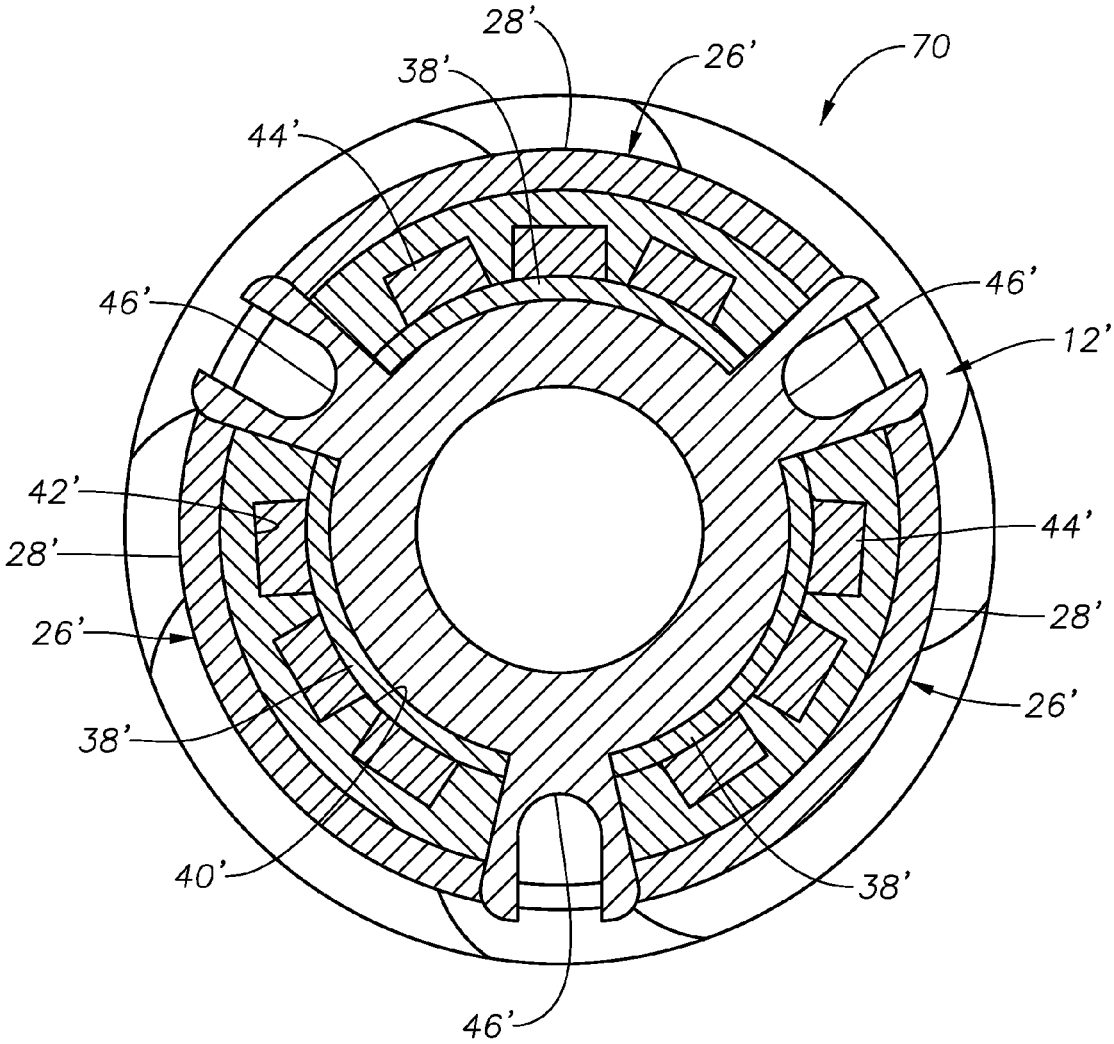
FIG. 16 is an axial cross-section of an assembled magnetic retrieval tool with magnetic bars in place.

FIGS. 10-16 depict an alternative magnetic retrieval tool 70 that is also constructed in accordance with the present embodiment. Except where indicated otherwise, construction and operation of the tool 70 mirrors that of the tool 10 described earlier. FIGS. 10, 11 and 15 illustrate a tool mandrel 12' having retaining pockets 20' and external fluid flowpaths 46'. In this embodiment, there are three pockets 20' and three flowpaths 46'. However, there may be more or fewer of these components, as desired on any particular tool mandrel. The tool mandrel 12' also includes a collar 22' having keyed openings 24'.

Figure 12:
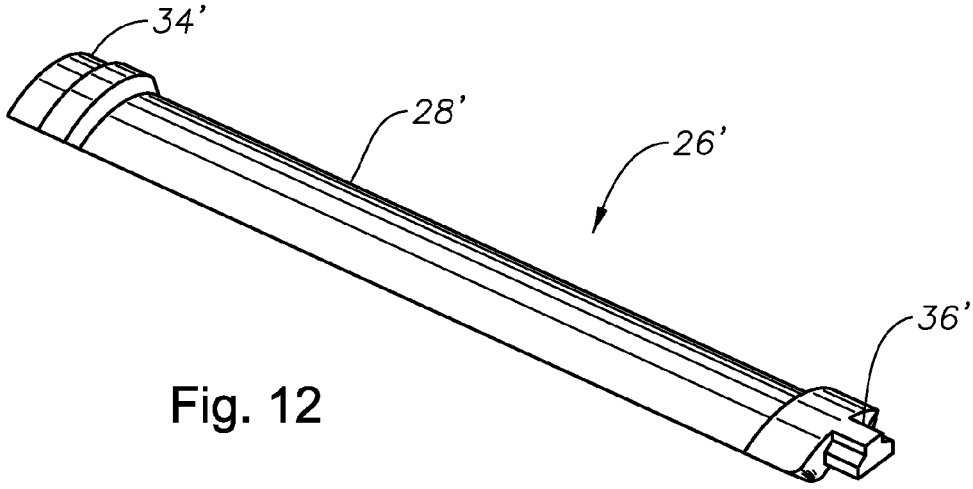
FIG. 12 is an isometric view of an exemplary magnetic bar used with the tool mandrel shown in FIGS. 10 and 11.

FIGS. 12-14 illustrate an exemplary magnetic bar 26' for use with the tool mandrel 12'. In use, one insert 26' is placed in each of the three pockets 20'. The insert 26' includes a key 36' that is shaped and sized to reside within one of the keyed openings 24'. The outer radial surface 28' of each insert 26' is substantially smooth and arcuately curved. The inner radial surface 40' of each insert 26' is provided with a plurality of magnet-retaining recesses 42'. The recesses 42' and the magnets 44' that are retained within the recesses 42' are disc-shaped. Cover 38' retains the magnets 44' within the recesses 42'.

Figure 17:
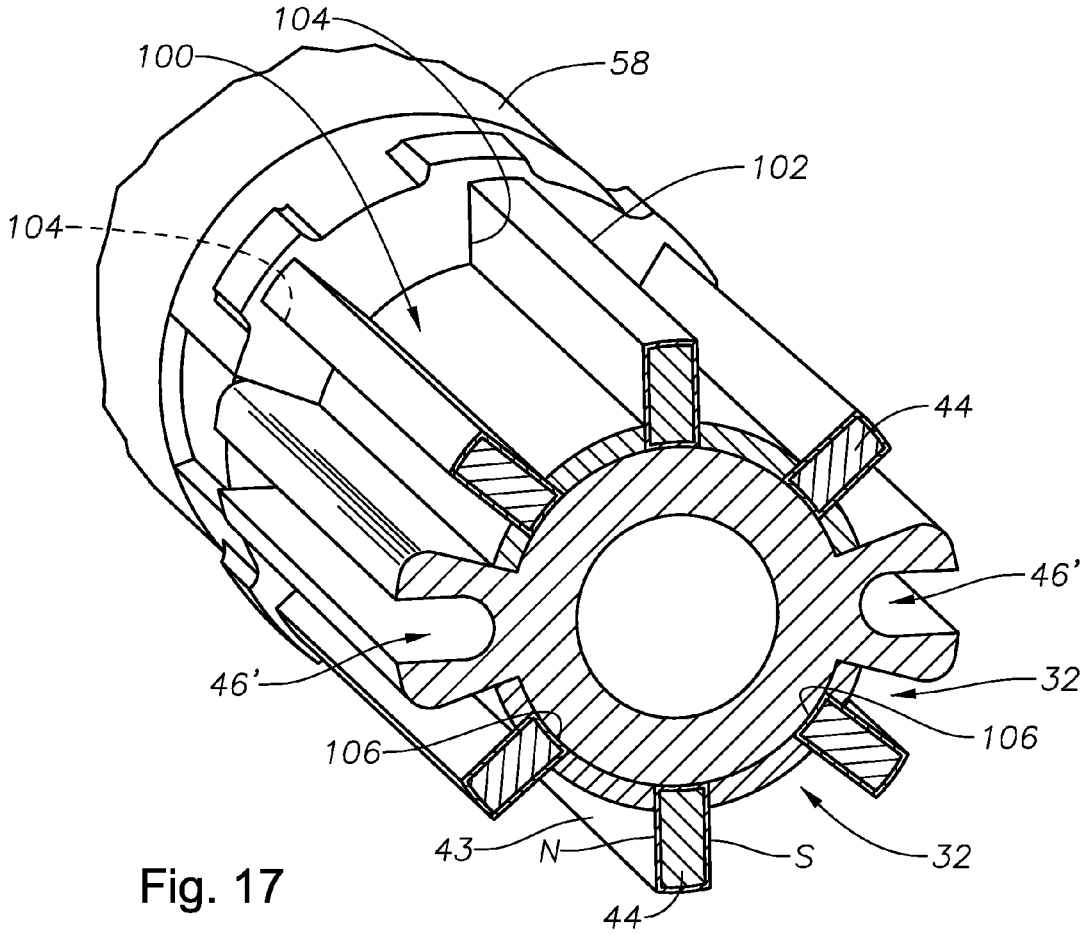
FIG. 17 is an external, cross-sectional view of an alternative embodiment for a tool constructed in accordance with the present invention wherein magnets are retained within longitudinal slots in housings surrounding the central mandrel.
Figure 18:
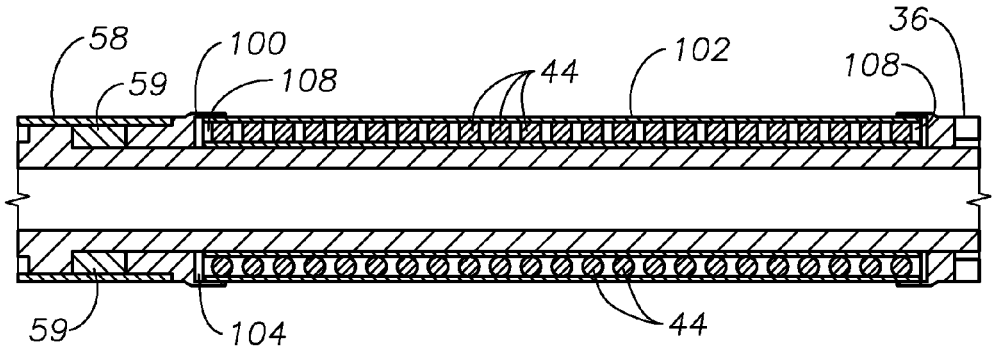
FIG. 18 is a side, cross-sectional view of portions of the exemplary tool shown in FIG. 17.

FIGS. 17 and 18 illustrate an alternative design for an insert 100 which could be used with the tool 10 in accordance with the present invention. The insert 100 retains a plurality of rectangular, non-magnetic magnet tubes 102. Magnets 44 are installed through the opening 108 at either end of the magnet tube 102. Magnets 44 form a fixed array or matrix surrounding the mandrel 12. Magnets 44 may be square, rectangular, round, or of other geometric shapes. In this embodiment, the inserts 100 each have a plurality of longitudinal slots 104 formed within. The slots 104 each have an internal opening 106. The slots 104 are each shaped and sized to receive one magnet tube 102. Multiple magnets 44 are disposed within magnet tube 102 in a side-by-side relation. As a result, both north and south magnetic poles of the magnets 102 are able to provide magnetic attraction on both lateral sides 43 of magnetic tube 102 and its respective fin 30. Metallic debris that is attracted by the magnets 44 will be captured within the recesses 32 between the magnet tubes 102. Once magnet tube 102 is installed in slot 104, the ends of slot 104 prevent magnets 44 from coming out of openings 108 at the end of the magnet tubes 102. Spacer 59 and retaining ring 58 retain insert 100 in recessed pockets 20 of mandrel 12.

FIGS. 19-21 depict a further alternative exemplary magnetic retrieval insert 110 for retaining a plurality of magnets in a fixed array or matrix about the central mandrel 12. As FIG. 19 shows, the insert 110 has a curved elongated housing 112 that is shaped and sized to removably reside within a pocket, such as pocket 20 on tool mandrel 12. The housing 112 presents a radially interior surface 114 within which is formed a one or more longitudinal channels 116. In the embodiment shown in FIGS. 19-21, there are three channels 116. Retaining slots 118 are also disposed within the housing 112 and are located within the channels 116. The slots 118 protrude deeper into the housing 112 than the channels 116 and, as illustrated in FIG. 21, largely extend into the fins 30 of the housing 112.

FIGS. 20 and 21 depict the insert 110 assembled with magnets 120 (one shown in FIG. 21) and retaining strips, or members, 122. The magnets 120 are each shaped and sized to reside in a complimentary fashion within one of the slots 118. The retaining strips 122 are then disposed within the channels 116, as shown in FIGS. 20 and 21 to retain the magnets 120 within the slots 118. Preferably, an interference fit is provided between the retaining strips 122 and the channels 116. The retaining strips 122 are preferably formed of non-magnetic material and thereby serve to magnetically isolate the magnets 120 from the mandrel 12 to some degree. It is noted that retaining strips or members might be in the form of linear strips of rubber O-ring material, of a type known in the art.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A magnetic retrieval tool for collecting metallic material from a surrounding tubular, the tool comprising:
- a tool mandrel having first and second axial ends and an outer radial surface;
- an insert removably disposed upon the tool mandrel, the insert comprising:
  - a housing;
  - a plurality of magnets retained within the housing in a fixed array at least partially surrounding the mandrel; and
- an exterior fluid flowpath defined upon the outer radial surface to permit fluid in a surrounding tubular to flow past the tool.

2. The tool of claim 1 further comprising:
- a pocket formed within the outer radial surface of the tool mandrel; and
- the insert is removably disposed within the pocket.

3. The tool of claim 1 wherein the housing of the insert further comprises:
- an inner radial surface and an outer radial surface; and
- a magnet-retaining recess formed within the inner radial surface for disposing a magnet within the housing.

4. The tool of claim 3 further comprising a retaining member disposed between the magnets and the mandrel.

5. The tool of claim 4 wherein the retaining member is formed of a non-magnetic material to provide magnetic isolation between the magnets and the tool mandrel.

6. The tool of claim 4 wherein the retaining member comprises a cover that is removably affixed to the housing.

7. The tool of claim 4 wherein the retaining member comprises a retaining string that is disposed within a complimentary channel in the housing.

8. The tool of claim 3 wherein the magnet-retaining recess comprises a longitudinal slot formed within the housing and having an opening for the insertion of one or more magnets into the slot.

9. The tool of claim 3 wherein the outer radial surface of the insert comprises:
- a plurality of outwardly radially-projecting fins; and
- a recess disposed between each two of said plurality of fins.

10. The tool of claim 9 wherein there is a plurality of magnet-retaining recesses, and each magnet-retaining recess is located at least partially within one of the fins.

11. The tool of claim 10 wherein:
- the fins present two lateral sides; and
- a magnet is retained within the magnet-retaining recess and provides magnetic attraction of both lateral sides of the fin.

12. The tool of claim 3 wherein the outer radial surface of the insert is substantially smooth.

13. The tool of claim 3 further comprising a magnet that is removably disposed within the magnet-retaining recess.

14. The tool of claim 13 wherein the magnet has an elongated, generally rectangular cross-section.

15. The tool of claim 13 wherein the magnet is disc-shaped.

16. The tool of claim 1 further comprising:

a key associated with the housing;

a keyed opening formed within the tool mandrel, the keyed opening being shaped and sized to be complimentary to the key; and the key being disposed within the keyed opening when the insert is disposed upon the housing.

17. The tool of claim 16 wherein the keyed opening of the tool mandrel is defined within a radially-enlarged collar.

18. A magnetic retrieval tool for collecting metallic material from a surrounding tubular, the tool comprising:

a tool mandrel having first and second axial ends and an outer radial surface;

an insert removably disposed upon the tool mandrel, the insert comprising:

a housing;

a plurality of magnets retained within the housing in a fixed array at least partially surrounding the mandrel;

the plurality of magnets being at least partially magnetically isolated from the mandrel;

the insert further presenting an outer radial surface comprising a plurality of outwardly radially-projecting fins and a recess disposed between each two of said plurality of fins.

19. The tool of claim 18 further comprising:

a pocket formed within the outer radial surface of the tool mandrel; and the insert is removably disposed within the pocket.

20. The tool of claim 18 further comprising a removable cover on a radially inner surface of the insert.

21. The tool of claim 18 wherein the housing of the insert further comprises:

an inner radial surface and an outer radial surface; and a magnet-retaining recess formed within the inner radial surface for disposing a magnet within the housing.

22. The tool of claim 18 wherein there is a plurality of magnet-retaining recesses, and each of the magnets are located within one of the fins.

23. A magnetic retrieval tool for collecting metallic material from a surrounding tubular, the tool comprising:

a tool mandrel having first and second axial ends and an outer radial surface;

an insert removably disposed upon the tool mandrel, the insert comprising:

a housing;

a plurality of magnets retained within the housing in a fixed array at least partially surrounding the mandrel;

a key associated with the housing;

a keyed opening formed within the tool mandrel, the keyed opening being shaped and sized to be complimentary to the key; and the key being disposed within the keyed opening when the insert is disposed upon the housing.

24. The tool of claim 23 further comprising:

a pocket formed within the outer radial surface of the tool mandrel; and the insert is removably disposed within the pocket.

25. The tool of claim 23 wherein the housing of the insert further comprises:

an inner radial surface and an outer radial surface; and a magnet-retaining recess formed within the inner radial surface for disposing a magnet within the housing.

* * * * *